United States Patent [19]

Caryotakis et al.

[11] 4,137,482

[45] Jan. 30, 1979

[54] PERIODIC PERMANENT MAGNET FOCUSED TWT

[75] Inventors: George Caryotakis, Menlo Park; George Chan, San Mateo; Louis R. Falce, Redwood City, all of Calif.; William R. Luebke, deceased, late of Redwood City, Calif., by Robin N. Luebke, executrix; Walter Wood, San Jose, Calif.

[73] Assignee: Varian Associates, Inc., Palo Alto, Calif.

[21] Appl. No.: 796,274

[22] Filed: May 12, 1977

[51] Int. Cl.[2] ..... H01J 25/34

[52] U.S. Cl. ..... 315/3.5; 315/5.35

[58] Field of Search ..... 315/3.5, 3.6, 5.35

[56] References Cited

U.S. PATENT DOCUMENTS

| | | | |
|---|---|---|---|
| 2,843,775 | 7/1958 | Yasuda | 315/3.5 |
| 3,404,306 | 10/1968 | Johnson | 315/3.5 |

FOREIGN PATENT DOCUMENTS

| | | | |
|---|---|---|---|
| 1195805 | 6/1970 | United Kingdom | 315/5.35 |

*Primary Examiner*—Saxfield Chatmon, Jr.
*Attorney, Agent, or Firm*—Stanley Z. Cole

[57] ABSTRACT

A traveling wave tube adapted for periodic magnetic focusing of the electron beam has a thin-walled, non-magnetic cylinder around the slow-wave circuit portion, forming part of the vacuum envelope. A stack of metal rings surrounding the cylinder has alternating non-magnetic rings and magnetic rings, the latter forming the periodic magnet pole pieces. The rings and the thin cylinder are all brazed together to provide a strong structure. Since the cylinder does not have to be self-supporting, it is made thin enough to allow close spacing between the pole pieces and beam, providing strong magnetic field and good focusing. The brazed joints between rings are not vacuum joints, so the probability of leaks is greatly reduced.

7 Claims, 4 Drawing Figures

FIG. 2
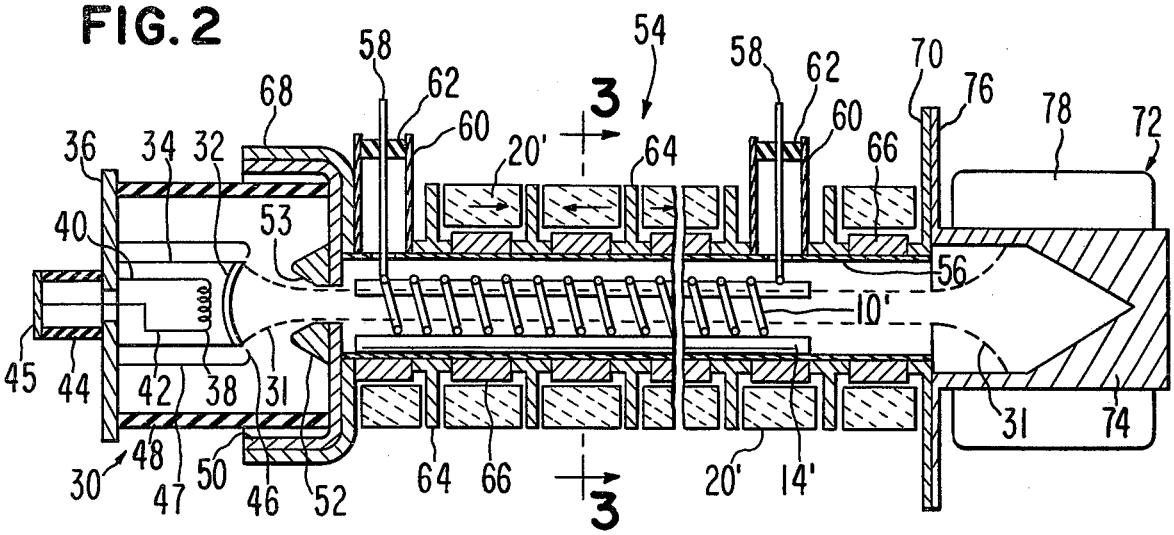
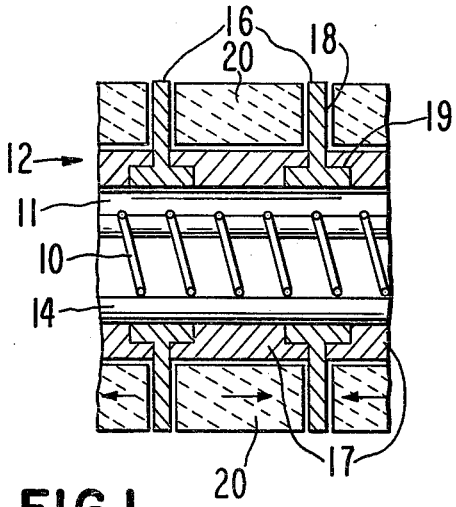
FIG. 1
PRIOR ART
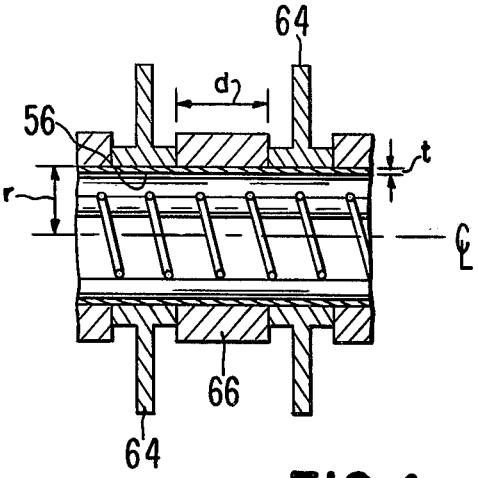
FIG. 4
FIG. 3
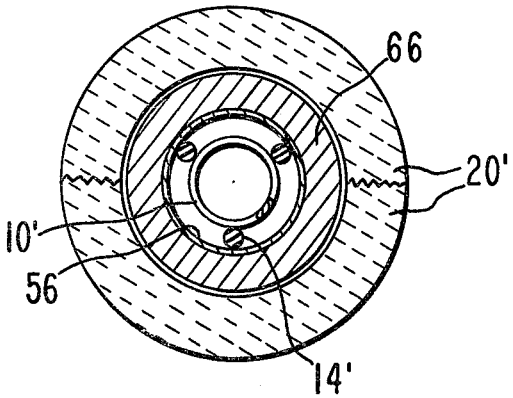

PERIODIC PERMANENT MAGNET FOCUSED TWT

Field of the Invention

The invention pertains to medium and low power traveling wave tubes (TWT's) in which the linear electron beam is focused by periodic permanent magnetics (PPM). In each successive period, the axial magnetic field is reversed in direction. For optimum utilization of the magnet material, and hence minimum weight and cost, the magnet pole pieces should extend as close to the beam as possible.

The principle of periodic focusing is well known. A magnetic field, symmetrical about the beam axis and periodically reversing in direction, behaves as a series of convergent magnetic lenses which overcome the tendency of the electron beam to diverge under the influence of its own space-charge forces. The total weight of magnetic material required is much less than that required for a straight-field magnet because the leakage fields are confined to a diameter comparable to the magnetic period instead of to the entire length of the magnet as would be the case for a straight-field magnet. It is well known that the amount of permanent magnet material required is proportional to the volume of space filled by the resultant field.

PPM focusing is described in "Power Travelling Wave Tubes" by J. F. Gittins, American Elsevier, New York 1965, pp. 107–112.

Prior Art

In the early uses of PPM focusing, a stack of permanent magnets was placed outside the glass or nonmagnetic metal envelope of a TWT. The magnets were typically short, hollow cylinders (washers) magnetized axially in alternating directions. An improvement was obtained by interleaving iron pole-piece washers between the magnets to concentrate the flux in the vicinity of the beam. U.S. Pat. No. 2,847,607 issued Aug. 12, 1958 to J. R. Pierce describes the principle of PPM focusing and discloses some alternative arrangements of magnets. These early schemes had the disadvantage that the maximum value of magnetic field at the position of the beam was limited by the distance of the pole pieces from the beam, since the field strength falls off rapidly with radial distance. The necessary thickness of the tube's vacuum envelope, added to the space required for the helix slow-wave circuit and its spacing inside the envelope, resulted in a considerable curtailment of the obtainable maximum field.

A prior-art scheme to improve the field strength has been called the "integral pole piece periodic permanent magnet". U.S. Pat. No. 3,300,678 issued Jan. 24, 1967 to N. E. Swenson discloses one embodiment of this scheme. A more common embodiment is illustrated in FIG. 1, more fully described below. The magnet pole pieces and intervening non-magnetic washers are made to be integral parts of the vacuum envelope. Thus, the pole pieces extend as close as possible to the beam. While the integral-pole-piece scheme optimizes the field, it has the great disadvantage that there are four vacuum joints between dissimilar materials for every magnetic period. Thus the probability of a vacuum leak is often unacceptably high.

SUMMARY OF THE INVENTION

The principle objective of the present invention is to provide a PPM focused TWT with optimum magnetic field strength in which the probability of vacuum leaks is minimized.

A further objective is to provide a PPM focused TWT of low cost but nevertheless accurate construction.

These objectives are realized by making the barrel of the tube of thin-walled cylindrical tubing, thick enough to be vacuum tight, but not necessarily thick enough to be structurally self-sufficient. Outside the thin-walled cylinder is a stack of rings of alternating magnetic and non-magnetic material. These rings are brazed together and to the thin cylinder to provide a structurally sound envelope with a precise inner bore.

BRIEF DESCRIPTION OF THE DRAWINGS

FIG. 1 is a partial section of a prior-art integral-pole-piece tube.

FIG. 2 is a schematic section through the axis of a TWT embodying the present invention.

FIG. 3 is a section perpendicular to the axis of the TWT of FIG. 2.

FIG. 4 is an enlarged view of a portion of FIG. 2.

DESCRIPTION OF THE PREFERRED EMBODIMENTS

FIG. 1 is a section through the axis of a portion of a prior art, integral-pole-piece TWT. This is a portion of the interaction section where the pencil beam of electrons (not shown) passes through and interacts with a helical slow-wave circuit 10. The focusing schemes of this prior art and of the present invention are particularly adapted to helix-type TWT's, because the helix-type slow wave circuits are quite small in diameter — in fact only large enough to clear the outside of the beam. This makes it possible to bring the periodic magnetic field in close enough to the beam to provide good beam focusing. Helix 10 is positioned inside a hollow bore in a generally cylindrical vacuum envelope 12 by means of a plurality of dielectric support rods 14 aligned axially and spaced circumferentially in bore 11. Support rods 14 may be of sapphire, alumina or beryllia ceramic, or of boron nitride. Envelope 12 comprises a stack of magnetic rings 16 interleaved with and spaced by non-magnetic rings 17. Rings 16 have washer-shaped flanges 18 for carrying magnetic flux to inner hub portions 19. The greater axial length of hubs 19 shortens the magnetic gap, concentrating the flux. Rings 16 may be of low-carbon steel or of a magnetic stainless steel. Non-magnetic spacers 17 are shaped to mate closely with magnetic rings 16. Spacers 17 may be of cupronickel, an alloy of copper with 10 to 30 percent nickel. Envelope section 12 is made by stacking the alternate magnetic rings 16 and non-magnetic rings 17 on a mandrel to keep the stack straight. Then the rings are brazed together with a suitable solder such as pure copper. The mandrel is then removed. The resulting bore 11 is not accurate enough to provide a good fit with the assembly of helix 10 and support rods 14, so it has usually been necessary to mechanically bend the stack and then machine the bore 11 as by a honing operation, which considerably increases the cost. After assembly and vacuum processing of the TWT, ring-shaped permanent magnets 20, as of Alnico are fitted between magnetic flanges 18. Rings 20 are ground to be a good fit. The gaps shown in FIG.

1 are exaggerated to illustrate that magnets 20 are removable. The direction of magnetization of magnets 20 shown by the arrows is reversed between each adjacent pair.

As described above, the envelope structure of FIG. 1 has two serious disadvantages. A large number of brazed joints must be made vacuum-tight. A single leak can ruin the whole structure. The brazing problem is made more severe because the joined materials are dissimilar, generally having different coefficients of thermal expansion so that the clearances for the brazing materials change with temperature and the joints when made are subject to mechanical stresses as the assembly cools. The other disadvantage is the lack of mechanical precision described above.

FIGS. 2 and 3 are sections through a TWT embodying the present invention. The TWT has an electron gun 30 for forming and projecting a pencil-shaped beam of electrons 31. Gun 30 comprises a concave thermionic cathode 32 such as a conventional oxide-coated nickel cathode. Cathode 32 is supported by an electrically conducting, thermally insulating support cylinder 34 from a metallic base plate 36. A radiant heater 38 as of tungsten wire is positioned behind cathode 32. One leg 40 of heater 38 is mounted on base plate 36. The other heater leg 42 extends through an opening in base plate 36, through an insulating vacuum bushing 44 to a heater lead terminal 45 to which heating current is supplied. A focus electrode 46 outside of cathode 32 is supported by a conducting cylinder 47 from base plate 36. Base plate 36 is mounted via a cylindrical ceramic vacuum bushing 48 sealed to base plate 36 and to a metallic gun flange 50, as of iron-nickel-cobalt alloy. At the center of flange 50 is a reentrant anode 52 projecting toward cathode 32 to draw the converging stream of electrons 31 which passes through a central aperture 53 in anode 52. The completed gun structure 30 is joined to the interaction structure 54 of the TWT as by arc welding.

Interaction section 54 comprises a helix slow-wave circuit 10' spaced by dielectric rods 14' inside a thin-walled metallic tube 56 which forms part of the vacuum envelope. The thin-walled envelope cylinder 56 is of non-magnetic material such as cupronickel. Other materials such as OFHC copper may however be used as long as they are vacuum-tight while having a wall thickness sufficiently small to allow pole pieces 64 to project inward to the vicinity of electron beam 31. Each end of helix 10' is connected to a wire center-conductor 58 which extends through a coaxial outer conductor 60 to form the input and output coaxial transmission lines of the tube. Coaxial ceramic insulators 62 sealed between wires 58 and outer conductors 60 provide the vacuum bushings. Outside cylinder 56 a stack of alternating magnetic rings 64 and non-magnetic rings 66 forms the periodic pole-piece structure. The rings are similar in form and function to the prior-art envelope members illustrated in FIG. 1, but since they are not required to provide the vacuum integrity a greater choice of materials is allowed. In assembling interaction section 54, rings 64 and 66 are stacked surrounding thin-walled cylinder 56 and all parts are brazed together to form a mechanically rugged, integral envelope structure. A brazing mandrel may be used inside cylinder 56. After the TWT is processed, periodic permanent magnet sections 20' are inserted between magnetic rings 64 as described above. As shown in FIG. 3, magnet rings 20' are broken into two pieces to allow their insertion.

The final portion of the TWT is the collector subassembly 72. This comprises a thermally conducting, hollow beam collector 74, as of copper, in which electron beam 31 expands after leaving interaction section 54 through which it was kept focused. Beam collector 74 is joined to a mounting flange 76 which in final assembly is joined as by welding to output flange 70 of interaction section 54. Heat produced by electron bombardment of beam collector 74 is dissipated as by convection fins 78. Liquid or conduction cooling to a heat sink may also be used.

FIG. 4 shows an enlarged partial section of the TWT of FIGS. 2 and 3. In order not to degrade the magnetic performance, the wall thickness t of cylinder 56 must be small compared to the gap d between pole pieces 64. It is known from the theories of periodic focusing that the gap d should be comparable to the inner radius r of the magnet structure. Hence the wall thickness t must be quite small compared to the radius r of thin walled cylinder 56. For example, in a TWT with inner radius r of 2.5 mm and a magnetic gap d of 3 mm a suitable wall thickness t would be in the range between 0.1 mm and 0.5 mm.

What is claimed is:

1. In a traveling wave tube, means to permit focusing a linear electron beam comprising:

a thin-walled, non-magnetic metallic tubular cylinder surrounding said beam and forming part of the vacuum envelope of said tube, said cylinder being vacuum-tight and being adapted and dimensioned to accommodate said beam passing therethrough, a plurality of rings stacked along the axis of said cylinder, each having a central opening fitting around said cylinder, said rings being alternately of magnetic and non-magnetic metal, said magnetic rings having external surfaces adapted to mate with permanent magnet members to couple magnetic flux between successive magnetic rings, said rings and said cylinder being mutually joined together to form a unitary mechanically rigid structure.

2. The tube of claim 1 wherein said cylinder has a wall thickness which is small compared to its transverse dimensions.

3. The tube of claim 1 wherein said cylinder is a right circular cylinder.

4. The tube of claim 3 wherein the surfaces of contact between adjacent rings are figures of revolution about said axis.

5. The tube of claim 1 wherein each of said rings except those at an end of said stack has a plane of symmetry perpendicular to said axis.

6. The tube of claim 1 including permanent magnets mated to said magnetic rings and coupling flux to successive magnetic rings in alternating directions.

7. The tube of claim 1 wherein said rings and said cylinder are joined together by a process of brazing.

* * * * *